US008137018B2

(12) United States Patent
Galván-Nañez

(10) Patent No.: US 8,137,018 B2
(45) Date of Patent: Mar. 20, 2012

(54) BATH SPONGE WITH INTEGRATED SOAP

(76) Inventor: Julia Galván-Nañez, Nuevo Leon (MX)

( * ) Notice: Subject to any disclaimer, the term of this patent is extended or adjusted under 35 U.S.C. 154(b) by 1166 days.

(21) Appl. No.: 11/979,683

(22) Filed: Nov. 7, 2007

(65) Prior Publication Data

US 2009/0089954 A1 Apr. 9, 2009

(30) Foreign Application Priority Data

Oct. 4, 2007 (MX) ..... MX/U/2007/000369 U

(51) Int. Cl.
*A47K 7/02* (2006.01)

(52) U.S. Cl. ..... 401/201; 300/21; 15/229.113

(58) Field of Classification Search ..... 15/209.1, 15/229.11; 300/21; 401/201, 196
See application file for complete search history.

(56) References Cited

U.S. PATENT DOCUMENTS 6,443,527 B1 * 9/2002 Borcherds et al. ..... 300/21
6,659,669 B1 * 12/2003 Nguyen ..... 401/8
6,839,931 B2 * 1/2005 Chen ..... 15/209.1
6,839,932 B2 * 1/2005 Huang ..... 15/229.11
7,401,864 B2 * 7/2008 Chang ..... 300/21

* cited by examiner

*Primary Examiner* — David Walczak
(74) *Attorney, Agent, or Firm* — Breiner & Breiner, LLC

(57) ABSTRACT

A bath sponge with integrated soap and a method of making the bath sponge. The method of making the bath sponge includes providing an assembly device formed with a base and two vertical posts. A polyethylene net is inserted over the top of the vertical posts and then the net is cut to a desired size. Folds are made in the net. Soap granules are poured into the net and are held within the folds, thereby remaining in the interior of the net. A rope is then tied around the net between the two posts, thereby stretching the rope so that the center of the net is joined thereby. The net is stretched making the folds alternate inside and outside of the net. The bath sponge is used for personal cleaning and bathing and allows the user to wash without the need for a separate soap.

3 Claims, 2 Drawing Sheets

BATH SPONGE WITH INTEGRATED SOAP

FIELD OF THE INVENTION

The invention is directed to a scourer or sponge for personal hygiene and cleaning and a method of making the scourer or sponge. The scourer or sponge is composed of netting including soap granules.

BACKGROUND OF THE INVENTION

There is a variety of scourers or sponges which are used for skin care and cleaning which, for example, are used to take a bath. However, none of the current scourers have the advantage to soap the area to be scrubbed, it is necessary to use soap or a soapy solution separately in order to get an integral cleaning.

SUMMARY OF INVENTION

This invention is based on a polyethylene-extruded net in which little soap granules or particles are integrated, which is easily made due to the simplicity of the assembly device.

Through the invention, and as a consequence of its manufacturing process, a very simple and economic sponge is provided which will benefit advantageously the user.

The objective of this invention is to provide a scourer or sponge for personal hygiene and cleaning, which allows the user thereof to clean him/herself without the need of using soap separately.

DESCRIPTION OF THE DRAWINGS

The characteristic details of this invention are clearly shown in the following description and the attached figures containing an illustration of the invention and using the same reference numbers to indicate the same parts in the figures shown.

DESCRIPTION OF PREFERRED EMBODIMENTS

Figure 1:
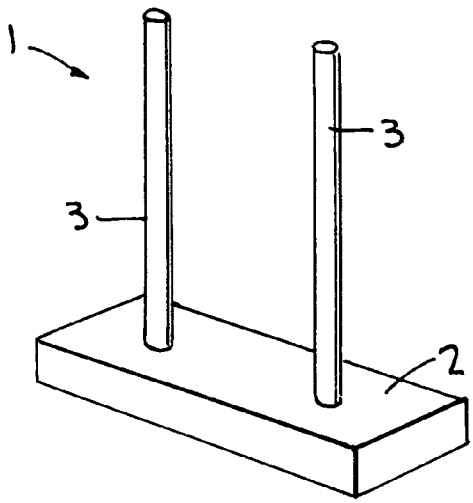
FIG. 1 shows a perspective view of the assembly device.

Based on such figures, this invention includes a combination of the assembly device (1) formed from a base (2) and two vertical posts (3). The invention also has a net (4), preferably made of polyethylene, which is inserted through the upper part of the assembly device (1) and a tying rope (5), in which a knot (6) has been previously made joining its ends, is used as a thread around the net (4) and, by means of another knot (6A), secures the rope (5) which is to be fixed to the net (4).

Figure 2:
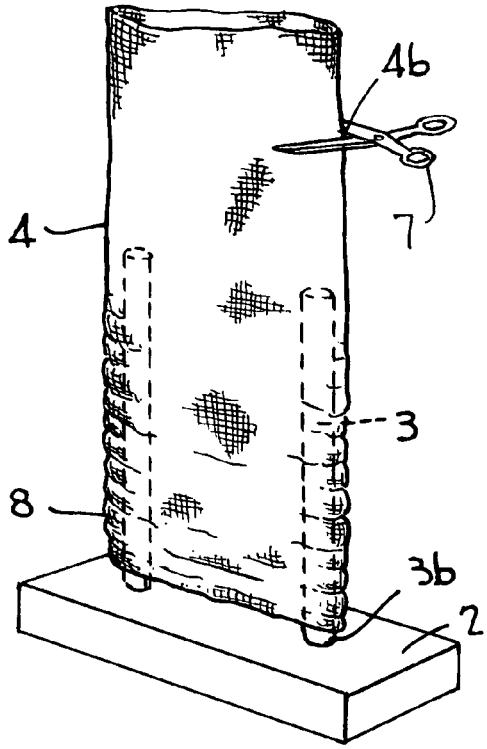
FIG. 2 shows a perspective view of a manner used to insert a net in the assembly device, taking into account that when the necessary length is obtained, the net is cut.
Figure 3:
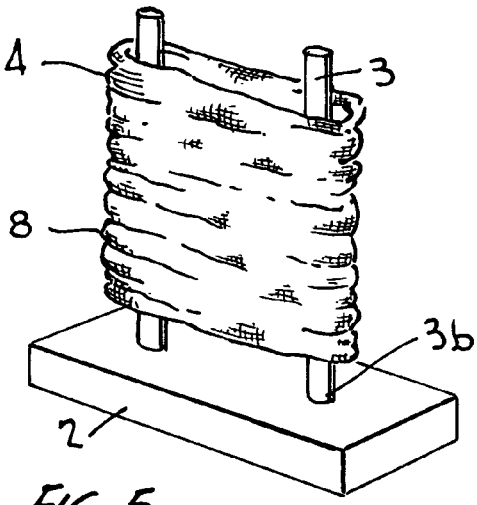
FIG. 3 shows a perspective view of the net in the assembly device forming folds.
Figure 4:
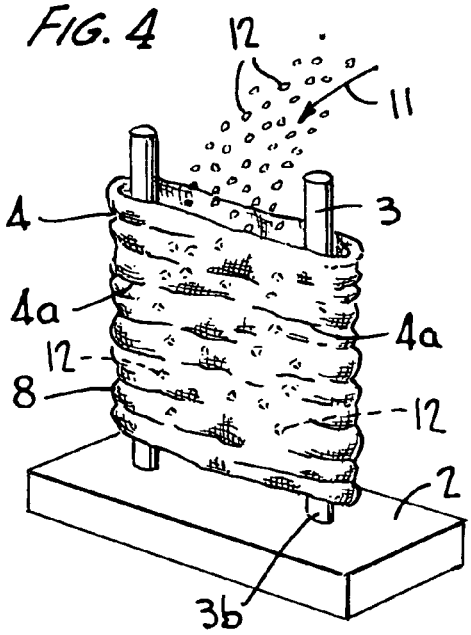
FIG. 4 shows a view of the folds formed and the manner in which soap granules are incorporated, which may be with or without fragrance, in order to remain between the net's folds.
Figure 5:
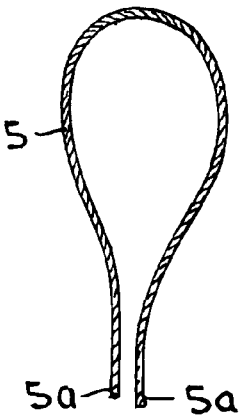
FIG. 5 shows a front view of a tying rope.
Figure 6:
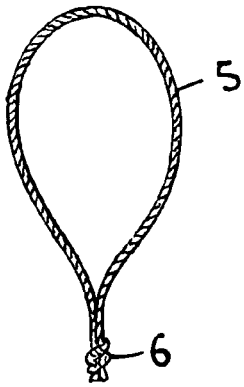
FIG. 6 shows a front view of the tying rope joined at its ends with a knot.
Figure 7:
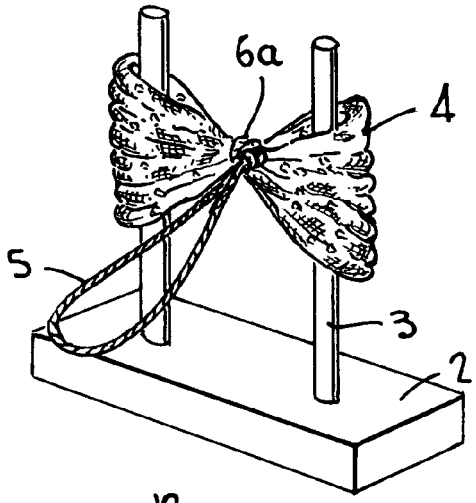
FIG. 7 shows the tying rope tied around the net, between the two posts and knotted.
Figure 8:
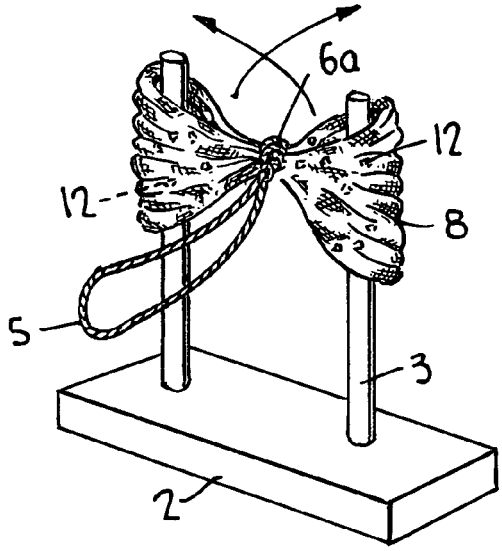
FIG. 8 shows the manner in which the net stretches to make the folds which alternate from the inside and outside of the device.

The method of manufacturing the scourer or sponge consists of inserting the net (4) in the assembly device (1) and sliding it from top to bottom towards the lower end of the vertical posts (3B), thereby making the folds (8) which are necessary for the size that the sponge must have. Once the foregoing is done, (see FIG. 2), the net is cut (4) in its upper end (4*b*) using scissors (7). Once the entire net (4) has been inserted in the assembly device (1) and the folds are made (8) (see FIGS. 3 and 4), soap granules or particles (12) are poured (11) into the interior of the net, which may be scented or unscented (see FIG. 4), and located in the folds (4*a*) resulting from introducing the net (4) in the posts (3). As a consequence of the folds, the soap particles or granules are held between the folds (4*a*) thereby remaining in the interior of the net. Then, the tying rope (5), with a knot previously made (6) in its ends (5A), is passed around the net (4), between the two posts (3) and one end is inserted in the other end forming a thread, stretching the rope (5) in a manner that the net (4) is put together in the center (see FIG. 7) and then another knot (6A) is made to insure that the thread which holds the net is fixed in place.

Figure 9:
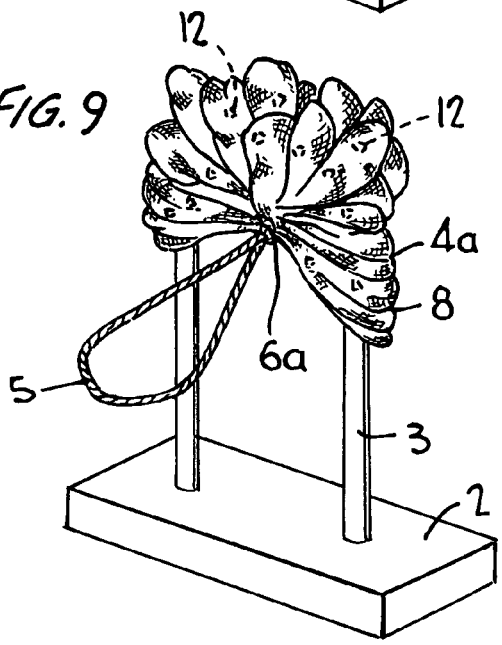
FIG. 9 shows a perspective view of the assembly device, the net and the rope which illustrates the manner in which the net is extracted from the device.
Figure 10:
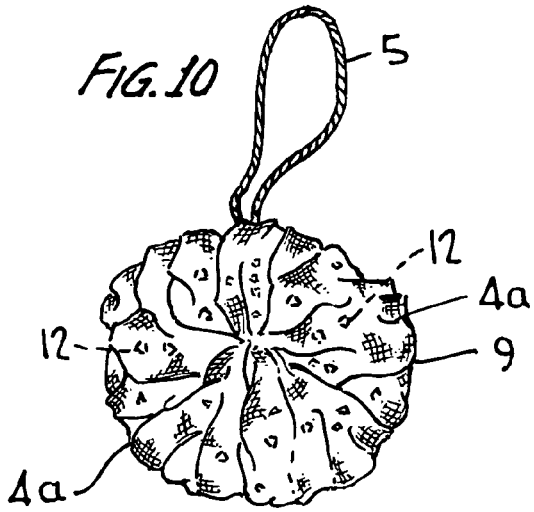
FIG. 10 shows a perspective view of the bath scourer once the assembly process is finished.

Then, the net (4) is stretched with the folds (8) which contain the soap granules in their interior in alternate manner inwards and outwards of the device (1) as shown in FIG. 9 achieving in this manner the bath sponge or scourer as shown in FIG. 10.

The invention claimed is:

1. A method of making a bath sponge with integrated soap comprising providing an assembly device comprising a base with two spaced apart vertical posts extending upward from the base, inserting a net onto the two vertical posts by sliding the net downward on the two posts in such a manner to create folds in said net, introducing soap granules into the folds of the net, extending a rope in looped configuration around a portion of the net positioned between the two posts to join the net in a central portion of the net, fixing the rope to the net, alternating stretching the folds in the net, and extracting the net from the assembly device.

2. A bath sponge produced according to the method of claim 1.

3. A combination for making a bath sponge with integrated soap comprising an assembly device comprising a base with two spaced apart vertical posts extending upward from the base;

a net constructed and arranged for insertion on the assembly device, the net forming folds upon insertion;

soap granules held in folds of said net upon placement in said folds due to structure of said folds; and a rope constructed to tie around said net and be fixed to said net.

* * * * *